United States Patent [19]

Marlin et al.

[11] 4,030,894

[45] June 21, 1977

[54] STABILIZED FUEL SLURRY

[75] Inventors: Louis Allen Marlin, Crestwood; Victor D. Beaucaire, Orland Park, both of Ill.

[73] Assignee: Interlake, Inc., Oak Brook, Ill.

[22] Filed: June 30, 1975

[21] Appl. No.: 591,312

[52] U.S. Cl. ..... 44/51
[51] Int. Cl.[2] ..... C10L 1/32
[58] Field of Search ..... 44/51

[56] References Cited

UNITED STATES PATENTS

| | | | |
|---|---|---|---|
| 3,210,168 | 10/1965 | Morway | 44/51 |
| 3,617,095 | 11/1971 | Lissant | 44/51 |

*Primary Examiner*—Floyd D. Higel

*Assistant Examiner*—Mrs. Y. Harris-Smith

*Attorney, Agent, or Firm*—Prangley, Dithmar, Vogel, Sandler & Stotland

[57] ABSTRACT

A method of preparing a stabilized fuel slurry is disclosed wherein a petroleum fuel oil is mixed with run of the mine coal and with an emulsifier, which is capable of forming a thixotropic water external-oil high internal phase emulsion. The slurry is mechanically mixed to comminute the coal to produce a stabilized fuel slurry with coal particles having diameters as large as about ¼ inch. The slurry is injected through lances into a blast furnace, the lances may provide concentric streams of slurry and steam. The slurry may also be used in other fuel burning furnaces such as boilers, cement kilns, etc.

12 Claims, No Drawings

STABILIZED FUEL SLURRY

BACKGROUND OF THE INVENTION

Suspensions of coal and coal by-products in fuel oil have been proposed as a fuel for blast furnaces, boilers and other fuel burning devices, but because of the explosion hazard in grinding dry coal and the difficulty in handling the suspensions, no practical system has yet been devised for the large scale use of this combination fuel.

U.S. Pat. No. 2,118,477, issued May 24, 1938 to Roberts teaches the combination of colloidal coal particles and oil to form a suspension for use as a composite fuel. The difficulty and expense in grinding coal to colloidal fineness, such that it passes through a 300 to 1,000 mesh sieve has prevented the composition fuel disclosed by Roberts from being used in present day furnaces.

U.S. Pat. No. 2,231,513, issued Feb. 11, 1948 to Stillman teaches a stable suspension of coal and oil made by pre-grinding coal particles until they pass through a 100-mesh screen and thereafter introducing the pre-ground particles into oil and subjecting the combination to a further grinding until the particle size is reduced to about 5 microns. All of the coal particles are small enough to pass through a 325-mesh screen, and at least 50% of the particles are under 10 microns in size, which is sufficient for the particles to produce the phenomenum known as the "Brownian Movement." The Brownian Movement of the particles is sufficient to maintain all of the coal particles in stable suspension.

Other patents, such as the Plauson et al. U.S. Pat. No. 1,647,471, issued Nov. 1, 1927, teach the combination of pre-ground carbonaceous material with an oil. The Plauson et al. patent teaches pre-grinding the carbonaceous material to a powder which passes through a 125 to 250 mesh screen, and thereafter, forming an emulsion with the oil by the addition of from about 1 to about 3% of a soap solution. The Plauson et al. patent has an additional disadvantage besides the small particle size of the carbonaceous material as the suspension or emulsion is produced in small batches using a cross hammer mill rotating at 325 feet per minute.

All of the above referred to patents teach combination liquid and solid fuels, which are difficult or dangerous to produce, resulting in the fact that combination solid and liquid fuels are presently not in use. Particularly, any method which requires that the coal be ground in the dry state presents a potential explosive hazard and should be avoided. Processes in which coal is colloidal in size require grinding times in excess of 5 or 6 hours, making the process uneconomical. These and other disadvantages are obviated by the present invention.

SUMMARY OF THE INVENTION

This invention relates to a stabilized fuel slurry and method of preparing same, and more particularly to a method of preparing a stabilized fuel slurry in which solid fuel particles are comminuted in liquid fuel oil to produce a stabilized fuel slurry having a solid fuel particles with diameters as large as about ¼ inch and the slurry prepared thereby.

It is a principal object of the present invention to provide a stabilized fuel slurry from "direct shipping coal" or "run of the mine" coal wherein the stabilized slurry contains solid fuel particles with diameters as large as about one-quarter inch.

Another object of the present invention is to provide a stabilized fuel slurry for injection into blast furnaces preferably with steam atomization.

Another object of the present invention is to provide a stabilized fuel slurry for burning in boilers. For example, the boilers may be integrated in a common fuel supply system with blast furnaces or they may completely separate. Use of the stabilized fuel slurry, however, is not limited to use in blast furnaces or boilers but may be utilized in other fuel burning devices.

Yet another object of the present invention is to provide a stabilized fuel slurry comprising a thixotropic water external-oil internal phase emulsion including an emulsifier capable of forming said emulsion present in the range of from about 0.2% by weight to about 5% by weight of the slurry, water present in the range of from about 2% by weight to about 30% by weight of the slurry, liquid fuel oil present in the range of from about 30% by weight to about 70% by weight of the slurry, and solid fuel particles with diameters as large as about ¼ inch dispersed in the emulsion and present in the range of from about 25% by weight to about 65% by weight of the slurry.

Still another object of the present invention is to provide a method of preparing the stabilized slurry set forth above including the steps of providing a liquid fuel oil, adding an emulsifier and water to the liquid fuel oil, adding solid fuel particles with diameters as large as about 2 inches to the mixture of liquid fuel oil and emulsifier and water, and comminuting the solid fuel particles to form a thixotropic waterexternal-oil high internal phase emulsion and a stabilized fuel slurry having solid fuel particles with diameters as large as about ¼ inch.

A further object of the present invention is to provide a method of the type set forth in which the thixotropic water external-oil high internal phase emulsion is formed before the solid fuel particles are added.

DESCRIPTION OF THE PREFERRED EMBODIMENT

The combination fuel of the present invention includes a liquid fuel oil which preferably is a petroleum product or coal product and includes crank case oil, crude oil, various fuel oils such as No. 6 fuel oil, raw coal tar and any other type of combustible oil. The combination fuel of the present invention also includes a solid fuel which may be any carbonaceous fuel such as coal, coke breeze, petroleum coke or residuum or any other solid combustible material.

The emulsifiers used in the combination fuel to provide a stabilized slurry are of the type disclosed in U.S. Pat. No. 3,617,095, issued Nov. 2, 1971 to Lissant. Particularly, emulsifiers of the type disclosed in the '95 patent in columns 3 and 4, may be used in combination with a non-oil, such as water, to provide the water external-oil high internal phase emulsions of the present invention.

In general, the slurry fuels of the present invention are produced in batch operations wherein the liquid fuel oil is mixed with water and emulsifier to form water external-oil high internal phase emulsion. Then, run of the mine coal or other solid carbonaceous fuel is added. A blade is driven at a high rotational speed simultaneously to disperse and to comminute the coal into particles having diameters less than about ¼ inch.

The resulting slurry is stabilized such that storage over relatively long periods of time results in no separation of the oil and the solid particles dispersed therein or of the water.

The stabilized slurry is pumpable as a normal liquid, the limitation in solid particle size being determined by the pumping apparatus. The stabilized slurry is then introduced into a blast furnace, preferably with steam, or may be introduced into any direct fired heater, furnace or boiler.

The advantages of the present invention reside in the use of "run of the mine" coal without pre-grinding or drying. the terms "run of the mine" and "direct shipping" refer to coal received from the mine without further treatment by the purchaser. Since dry coal is not pre-ground, pollutive dust and the concomitant explosive problems are obviated. As the resulting slurry is stable, water does not separate therefrom, thereby permitting direct injection of the slurry into the blast furnace without remixing. The dispersion of the stabilized slurry in the blast furnace is as good as a simple liquid fuel.

EXAMPLE 1

A 20 gallon Daymax disperser was charged with 30 weight percent, No. 6 fuel oil, to which was added 4.5 weight percent water, 0.5 weight percent emulsifier of the type described in the above-identified U.S. Pat. No. 3,617,095, and 65 percent by weight coal. The coal was run of the mine 2 inch by down coal. The mixture was dispersed after heating to 140° F. by an external heater plus the heat dissipated from the mechanical action of the disperser blade. The Daymax disperser was run for 10 minutes, after which the slurry was examined and found to be free of settling and free of coarse coal particles over ¼ inch diameter. The slurry was readily pourable and pumped without difficulty. Viscosity measurements showed increasing viscosity for the first eight minutes of mixing and a constant viscosity thereafter.

The No. 6 fuel oil used had an API specific gravity of 11.5, a SSF viscosity at 122° F. of 254, a sulfur content of 0.85% by weight, an ash content of 0.034% by weight and a rating of 150,750 BTU per gallon.

The coal was Illinois Old Ben No. 21 from Illinois seam No. 6, high volatile metallurgical coal with a moisture content of 9.6% by weight, volatile content of 37.24% by weight (dry basis), ash content of 6.44% by weight (dry basis). sulfur content of 1.6% by weight (dry basis) and a fixed carbon content of 56.32% by weight (dry basis). All the coal passed through a 2 inch mesh screen.

EXAMPLE 2

Example 1 was repeated using 70% weight percent No. 6 fuel oil, 4 weight precent water, 1 weight percent emulsifier and 25 weight percent coal. The mixture of the fuel oil, the water and the emulsifier were mixed for one minute in the Daymax disperser until a water external-oil high internal phase emulsion was formed. Run of the mine coal was added and the action of the disperser was continued for another 10 minutes, at which time the slurry was tested and found to be stabilized in that the coal did not settle, no water separated out and the entire slurry was readily pourable.

EXAMPLE 3

The process of Example 1 was repeated with No. 6 fuel oil being present in an amount of 45 percent by weight, run of the mine coal being present in an amount of 50 percent by weight, the water being present in an amount of 4.5 percent by weight and the emulsifier was present in the amount of ½ percent by weight. Even with the lesser amount of emulsifier, a satisfactory water external-oil high internal phase emulsion was formed and the resulting slurry was stable, wherein neither the coal nor the water separated. The resulting slurry was easily pourable.

EXAMPLE 4

The process of Example 3 was repeated with the exception that raw coal tar was substituted for the No. 6 fuel oil. In this example, raw coal tar was introduced into the disperser in an amount equal to 45 percent by weight of the final slurry. To the raw coal tar ½ percent by weight emulsifier and 4½ percent by weight water were added and this mixture was blended for about 1 minute. After the one minute blending in which a water external-oil high internal phase emulsion was prepared, the run of the mine coal in an amount equal to 50 percent by weight of the final slurry was introduced into the disperser. The blade was run for an additional 10 minutes at which time a substantially stable slurry was prepared.

EXAMPLE 5

The process of Example 3 was repeated with exception that coke breeze was substituted for the run of the mine coal in Example 3. The same water external-oil high internal phase emulsion was formed prior to the addition of the coke breeze and thereafter mixing continued for 8 to 10 minutes. Since coke breeze is an extremely abrasive material, the blade of the disperser was seriously worn by the coke breeze. This problem is remedied by substitution of a harder material for the usual blade.

EXAMPLE 6

The process of Example 1 was repeated in which 0.2 weight percent emulsifier was used in conjunction with 65% by weight coal, the remainder being No. 6 fuel oil. No free water was added; however, sufficient water was entrained in the coal to form the necessary water external-oil high internal phase emulsion. The slurry was stored over high at 150° F. and inspected the next day. No settling of the coal occurred, whereby a stabilized slurry resulted.

A screen analysis was obtained for the slurry thus prepared in which the following numbers represent the cummulative percent by weight of coal which does not pass through the identified screen.

8 – 0.29%
12 mesh – 3.26%
25 mesh – 31.5%
35 mesh – 45.5%
70 mesh – 80.0%
100 mesh – 89.9%
140 mesh – 95.9%
200 mesh – 99.9%

In the process of the present invention, it is preferred to continue mixing the emulsion and coal dispersion until the maximum diameter of coal particle remaining is ⅛ inch, with finer particles being present. It is apparent from the above screen analysis, that the majority of the particles are much finer than ⅛ inch in diameter. The fuel has better burning qualities if the particles are ground to smaller particle size; however, it is clear from the foregoing description that the colloidal size of the prior art is not necessary to the successful use of the slurry of the present invention as a fuel.

In all of the above examples, the temperature of the mixture in the disperser was maintained at 140° F. Stabilized slurries have been prepared with the temperature being as low as about 100° F.; however, this entails a longer mixing time in order to get the desired emulsion. Accordingly, while temperatures may be as low as 100° F., it is preferred that temperatures of the mixture be maintained at about 140° F. during the preparation of the stabilized slurry. After the stabilized slurry has been prepared, the mixture is allowed to cool and is generally reheated prior to injection into a blast furnace. Temperatures higher than 140° F. can be used but are more expensive. Low viscosity fuels, such as waste crank case oil, can be used at room temperature.

The fuel oil used may be present in an amount from as low as 30% by weight of the final slurry to as much as 70% by weight of the final slurry, the greater amount of solid fuel being present the cheaper the fuel and hence the more desirable the slurry. If less than 30 weight percent fuel oil is used, the slurry is too difficult to pump. The various liquid fuel oils used have included No. 6 fuel oil, waste crank case oil and raw coal tar. Clearly, other fuel oils such as kerosene and the like may be used, but they are more expensive and hence undesirable.

The solid fuels used in making up the stabilized slurries of the present invention have generally been selected from carbonaceous materials such as run of the mine coal, coke breeze, petroleum coke or residuum. Asphalt is also acceptable since it is a weak solid and readily disintegrates with mechanical mixing.

With respect to the relationship between the mixing temperature and the mixing time, the higher the temperature, the lower the viscosity of the liquid fuel oil and hence the easier the mixing. Conversely, the lower the temperature, the higher the viscosity and the more difficult the mixing is and hence a longer mixing time is required. The balancing between longer mixing time and higher temperature is essentially a trade-off. The preferred temperature is about 140° to 150° F., but this clearly can be varied. Additionally, mixing times were held to between about 8 and 10 minutes, which is very desirable since it allows large batch quantities of the fuel slurry to be made rather rapidly. Also, it is understood that with larger volumes of fuel, the mixing time may go up slightly; however, certainly the prior art mixing times of 5 to 6 hours will not be required for preparing the composite fuel of the present invention. Even with batches many times greater than those set forth in the examples, the longest mixing time envisioned is in the order of 15 minutes to ½ hour.

The stabilized slurry was used as a fuel in blast furnaces and was introduced into the blast furnaces through lances each of which is comprised of concentric pipes, with the inner pipe having an inner diameter off ⅜ inches and the outer pipe having a steam flow area of 0.1075 square inches. The desired flow rate for the slurry into the blast furnace is 2 gallons per minute with as many as 10 lances being used to inject the slurry into the blast furnace, thereby resulting in 20 gallons per minute slurry flow into the blast furnace. It has been found that the preferred flow of 2 gallons per minute per lance can be accomplished with a pipe having a ⅜ inch internal diamter, using 60 pounds of pressure per square inch, provided that the fuel is maintained at about 140° F. Clearly, maintaining the fuel at a lower temperature will require a greater pressure to force the slurry through the lance since the slurry will be more viscous at the lower temperature and, also, if the internal diameter of the lance is smaller than a greater pressure will be required. Again, as previously discussed, these are trade-offs between the energy required to pump the slurry at a higher pressure and the energy required to heat the slurry to a higher temperature. When the slurry is injected into the blast furnace, the outer concentric pipe of the lance is used simultaneously to inject steam, thereby to atomize the slurry as it enters the blast furnace and to prevent build-up of slurry crust on the pipe opening.

The composition of the slurry may vary, as previously discussed, orver a wide range; however, it is generally desired that the proportion of solid fuel be as high as possible without introducing unacceptable pumping problems and also that the proportion of water be as low as possible without compromising the stability of the slurry. As previously discussed, coal may be used up to about 65% by weight of the slurry without unacceptable loss of slurry flowability or pumpability. The lower limit for the solid fuel particles in the slurry is determined by the economics of preparing and pumping the slurry. Generally, preparing a slurry with less than about 25% by weight solid particles is uneconomical.

Account must be taken of the theoretical flame temperature when the slurry is burned as fuel in the blast furnace. When the slurry is introduced into the blast furnace, the water is converted into reducing gases that perform useful functions in cooler portions of the blast furnace, as well as aiding in the atomization of the slurry. Slurries containing between about 5% by weight and 15% by weight water are preferred; however, slurries containing up to 30% by weight water are useful in furnaces equipped for very high temperature air preheating or oxygen enriched air. If less then about 2% water or other non-oil is incorporated in the slurry, than the water external-oil high internal phase emulsion is not formed and the slurry is not stable. Accordingly, the useful range of water or other non-oil in the slurry is between from about 2% by weight to about 30% by weight of the final slurry.

The amount of emulsifier used to produce the high internal oil phase emulsion has been as low as 1/5% by weight. Since the emulsifiers are an extremely expensive ingredient, it is desirable to reduce the emulsifier to as low as possible percentage. On the other hand, emulsifier present in an amount as great as 5% by weight does no harm to the stabilized slurry but merely adds expense in the preparation. Smaller amounts of emulsifier such as 1/7 or 1/10 of 1% are clearly desirable, with satisfactory emulsions having been prepared using 0.2% by weight emulsifier. The particular emulsifier used in the examples are those described in the aforementioned U.S. Pat. No. 3,617,095, and are sold by the Tretolite Division of the Petrolite Corporation, under the trade designation LMF-4150 and LMP-4150A.

While there has been described herein a preferred method for preparing a stabilized slurry and a preferred method for injecting same into a blast furnace, it will be understood that other modifications and alterations may be made without departing from the true spirit and scope of the present invention. It is intended that all such modifications and alterations be covered in the appended claims.

What is claimed is:

1. A method of preparing a stabilized fuel slurry having liquid fuel oil present in the range of from about 30% by weight to about 70% by weight, solid fuel particles with diameters as large as about ¼ inch present in the range of from about 25% by weight to about 65% by weight, water present in the range of from about 2% by weight to about 30% by weight and an emulsifier capable of forming a thixotropic water external-oil high internal phase emulsion present in the range of from about 0.2% by weight to about 5% by weight, said method comprising providing a liquid fuel oil adding an emulsifier and solid fuel particles having diameters as large as about 2 inches and water to the liquid fuel oil, and agitating the solid fuel particles with the water, liquid fuel oil and emulsifier to form a thixotropic water external-high internal phase emulsion and to comminute the solid fuel particles in a liquid environment and to form a stabilized fuel slurry having solid fuel particles with diameters as large as about ¼ inch.

2. The method of preparing a stabilized fuel slurry set forth in claim 1, wherein the liquid fuel oil is present in the range of between about 30% by weight and about 50% by weight of the slurry.

3. The method of preparing a stabilized fuel slurry set forth in claim 1, wherein said liquid fuel oil is a petroleum oil.

4. The method of preparing a stabilized fuel slurry set forth in claim 1, wherein said liquid fuel oil is coal tar.

5. The method of preparing a stabilized fuel slurry set forth in claim 1, wherein the solid fuel is selected from the class consisting of coal, coal by-products and solid petroleum residuum.

6. The method of preparing a stabilized fuel slurry set forth in claim 1, wherein said solid fuel particles are present in the range of from about 50% by weight to about 6% by weight of the slurry.

7. The method of preparing a stabilized fuel slurry set forth in claim 1, wherein said solid fuel particles are comminuted until the largest of said particles is no larger than about ⅛ inch in diameter.

8. The method of preparing a stabilized fuel slurry set forth in claim 1, wherein the solid fuel particles are comminuted by mechanical mixing.

9. The method of preparing a stabilized fuel slurry set forth in claim 1, and further comprising maintaining the slurry at a temperature above about 100° F. during the mixing of the liquid fuel oil and the emulsifier and the solid fuel particles.

10. The method of preparing a stabilized fuel slurry set forth in claim 1, wherein the solid fuel particles are coal and the water is contained therein.

11. A method of preparing a stabilized fuel slurry having a petroleum present in the range of from about 30% by weight to about 70% by weight, coal particles with diameters as large as about ¼ inch present in the range of from about 25% by weight to about 65% by weight, water present in the range of from about 2% by weight to about 30% by weight and an emulsifier capable of forming a thixotropic water external-oil high internal phase emulsion present in the range of from about 0.2% by weight to about 5% by weight, said method comprising providing a liquid petroleum oil, adding an emulsifier and water to the petroleum oil, mixing the petroleum oil and the emulsifier and the water for a period of at least about 1 minute to form the thixotropic water external-oil high internal phase emulsion, adding coal particles with diameters as large as about 2 inches to the emulsion, and mechanically mixing the emulsion and the coal particles for a period of time in the range of from about ten minutes to about thirty minutes to comminute the coal particles and to form a stabilized slurry having coal particles with diameters as large as about ¼ inch.

12. The method of preparing a stabilized fuel slurry set forth in claim 11, wherein the petroleum oil and the emulsifier and the water and the coal particles are maintained at a temperature of at least about 140° F. during the mixing thereof.

* * * * *

UNITED STATES PATENT AND TRADEMARK OFFICE

CERTIFICATE OF CORRECTION

PATENT NO. : 4,030,894

DATED : June 21, 1977

INVENTOR(S) : Louis Allen Marlin and Victor D. Beaucaire

It is certified that error appears in the above-identified patent and that said Letters Patent are hereby corrected as shown below:

Column 2, line 56, "'95" should be --'095--.
Column 4, line 49, "high" should be --night--;
line 56, "8" should be --8 mesh--;
line 62, "95.9%" should be --95.5%--.
Column 5,
line 62, "off" should be --of--.
Column 6, line 19, "orver" should be --over--;
Column 7, line 43, "6%" should be --65%--.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*